United States Patent [19]

Garlaschi

[11] 4,364,256

[45] Dec. 21, 1982

[54] LATCHING DEVICE FOR THE PUNCH-CARRIER PLATE OF A PRESS FOR MOULDING SCREWS, RIVETS AND LIKE ARTICLES

[76] Inventor: Eufemia Garlaschi, Via Victor Hugo 4, Milan, Italy

[21] Appl. No.: 242,926

[22] Filed: Mar. 12, 1981

[30] Foreign Application Priority Data

Dec. 22, 1980 [IT] Italy ..... 23708/80[U]

[51] Int. Cl.[3] ..... B21D 22/00

[52] U.S. Cl. ..... 72/356; 72/403; 10/11 A; 10/13

[58] Field of Search ..... 72/356, 403, 405, 447; 10/11 A, 11 T, 13, 12 T

[56] References Cited

U.S. PATENT DOCUMENTS 2,386,550 10/1945 Hesselman ..... 10/13
3,245,097 4/1966 Domingo ..... 10/13
3,755,839 9/1973 Enody et al. ..... 10/13
3,945,072 3/1976 Enody et al. ..... 72/447
3,965,716 6/1976 Suzuki ..... 72/356

*Primary Examiner*—Leon Gilden
*Attorney, Agent, or Firm*—Stevens, Davis, Miller & Mosher

[57] ABSTRACT

For releasably latching the punch-carrier plate in a press for moulding screws, rivets and like articles from wire blanks, a latching member is provided which has a front hollow space which is adapted alternately to engage either of two projecting extensions integral with the punch plate, said latching member being biassed by springs which normally urge the front hollow space thereof in engagement with either extension, a follower mechanism being additionally provided to shift the latching member against the bias of the springs to permit that the punch plate may be swung towards either of its two working positions.

4 Claims, 6 Drawing Figures

LATCHING DEVICE FOR THE PUNCH-CARRIER PLATE OF A PRESS FOR MOULDING SCREWS, RIVETS AND LIKE ARTICLES

This invention relates to a latching device for the punch-carrier press of a press for moulding screws, rivets and like articles.

As is known, the press for cold moulding screws, rivets and like articles are based on the coaction between one or more dies which receive the wires intended to be converted into screws, rivets and like articles, and two or more punches which have the task of deforming, generally in two or more sequential blows, the portions of the wire sections exiting the die(s) to shape the heads of such screws, rivets and like articles. The die(s) are mounted in preselected positions in the press frame, whereas the punches are born by a plate mounted on a so-called ram, the latter sliding, rectilinearly and reciprocally, in specially provided ways of the frame along a direction parallel to the die axis.

The punch-carrier plate is mounted on the ram displaceably and is normally swinging in order to be enabled to bring the attendant punches in alignment with the die axes before each active stroke of the ram.

It is apparent that such an alignment must be extremely accurate and stable during each ram blow, in order that a quite satisfactory centering of the heads of the screws or the rivets to be moulded may be achieved relative to their respective stalk axes.

It should be noted, moreover, that the up-to-date presses for moulding screws and the like must have a high working speed (number of blows per minute) and thus a high output potential, so that a high accuracy is a must, along with rapidity and reliability in performing the several controls and motion steps.

In the conventional presses having a punch-carrier plate mounted swingably on the ram, to obtain an accurate alignment of the punches relative to the die(s) and the latching of the plate in its relative positions of alignment during the active ram stroke, the ram carries, on its front surface where the punch-carrier plate is mounted, and in two lateral positions, screws or abutment lugs of the adjustable type, which are capable of cooperating with a jutting component part integral with the plate, said abutments thus defining two working positions of the plate on the ram. In addition, provision is made of a member which is slidably mounted on the ram and which is adapted to latch said projection of the plate against either abutment lug.

Such a conventional latching device is not devoid of a number of defects. In the first place, it is a source of an annoying and detrimental source of noises and of wear of the projecting component part of the plate as the latter, at every switching of position, bumps against either abutment lugs. In order that such a shortcoming may be offset, the speed at which the plate is displaced must compulsorily be reduced in order that the inertial forces may consequentially be reduced. Another drawback is the fact that it is necessary to provide on the front surface of the ram a number of supporting members for the abutment lugs, that which makes the preparation of the ram intricate. A certain complication of the adjustment of the press may also be accounted for, since it is necessary to provide a careful and accurate regulation of the abutment lugs in order that an accurate alignment of the punch(es) with the die(s) may be warranted when the punch-carrier plate is in its two working positions as defined by the stopping lugs.

Lastly, there is the hazard that, during the operation of the press, foreign bodies may become inserted between the stopping lugs and the projecting portion of the punch-carrier plate, the result being the upsetting of the accurate alignment between the punch(es) and the die(s).

An object of the present invention is to provide a device for latching the punch-carrier plate, said device being capable of doing away with the defects enumerated above for the conventional devices, and being concurrently in a position to attain higher speeds, an improved accuracy in the positioning of the plate while simplifying the construction and the adjustment.

This object is achieved, according to the invention, by a latching device which is comprised of a latching member slidably mounted on the press ram and having a front hollow space adapted alternately to coact with either of two projecting extensions integral with the punch-carrier plate, said latching member being subjected to the action of resilient means adapted to maintain said front hollow space engaged by either of said projecting extensions, means being additionally provided for controllably shifting said latching member, against the bias of said resilient means, clear of said projecting extensions to allow said punch-carrier plate to swing from either of its working position to the other and vice versa.

Preferably, the latching member has a conical front hollow space and also the two projecting extensions of the punch-carrier plate are correspondingly tapered so as to obtain an automatic centering in the latching positions.

The means for switching the latching member consist, with advantage, of a bell-crank lever which is mounted for rotation on the ram, either lever arm being engaged by the latching member but with a possibility of sliding motion, whereas the other lever arm carries a follower which is adapted to roll on a front surface of a control member mounted slidably on the press frame.

The latching device according to the invention permits to do away with the adjustable stopping lugs of the conventional mechanisms, so that no more bumps of the plate against stop lugs are experienced and the resultant noises are consequently suppressed. The switching steps can thus be effected at a higher speed and the regulation is facilitated. The construction of the ram is simplified and the risk of erroneous positioning due to interposed foreign bodies does no longer exist.

An exemplary embodiment of the device according to the invention will now be described hereinafter in more detail, reference being had to the accompanying drawings, wherein.

Of the press, which is conventionally known in general, a portion of the frame 10 is shown, which has, on a side, a block 11 carrying a die 12 and, on the other side, bears a ram 13 which is slidably and rectilinearly reciprocable in a direction parallel to the axis of the die 12.

In the example shown, a press with a single punch is in the question, and two punches, 14 and 15, can alternately cooperate therewithal.

Figure 1:
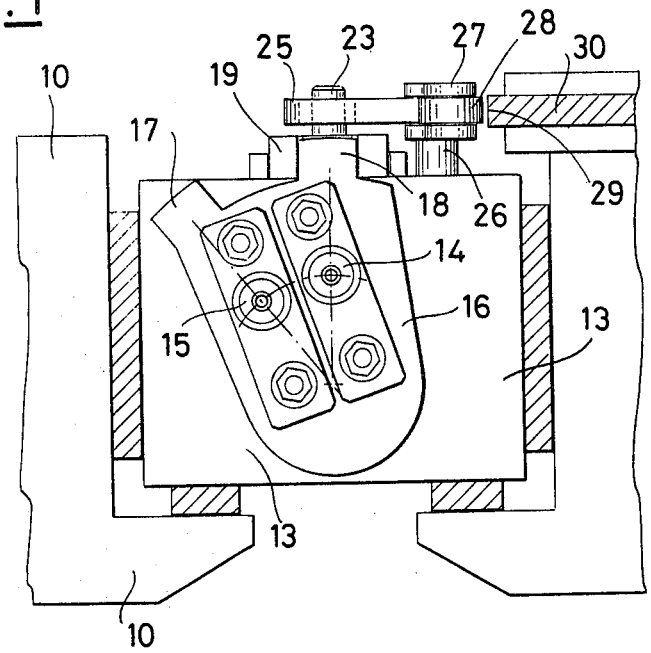
FIG. 1 is a front view of the ram with the punch-carrier plate latched in an operative position.
Figure 2:
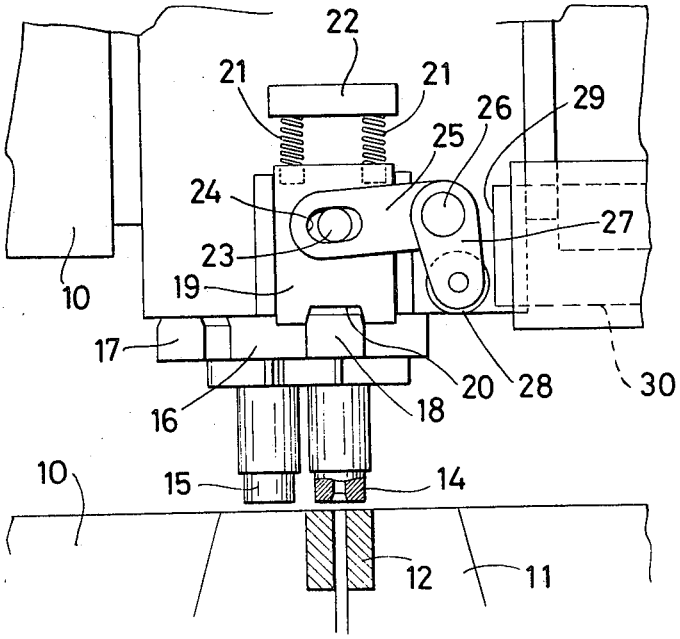
FIG. 2 is a plan view corresponding to FIG. 1.
Figure 4:
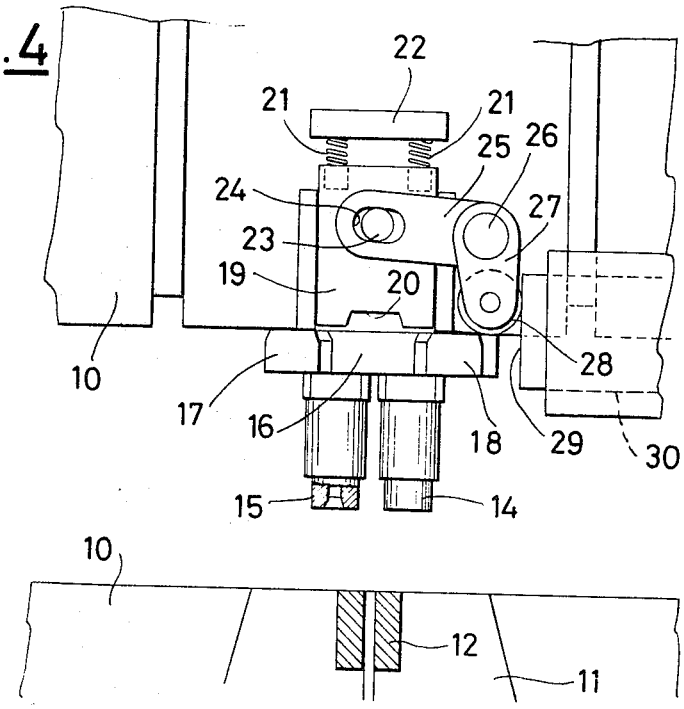
Figure 5:
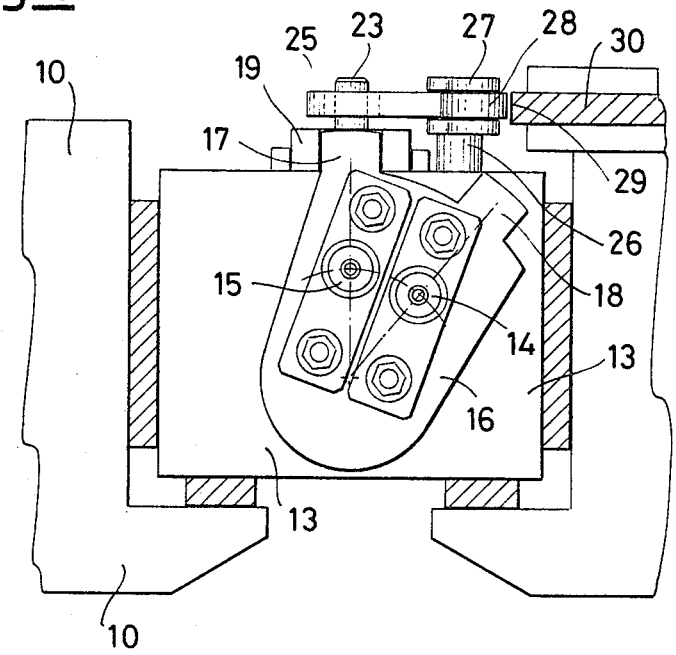
Figure 6:
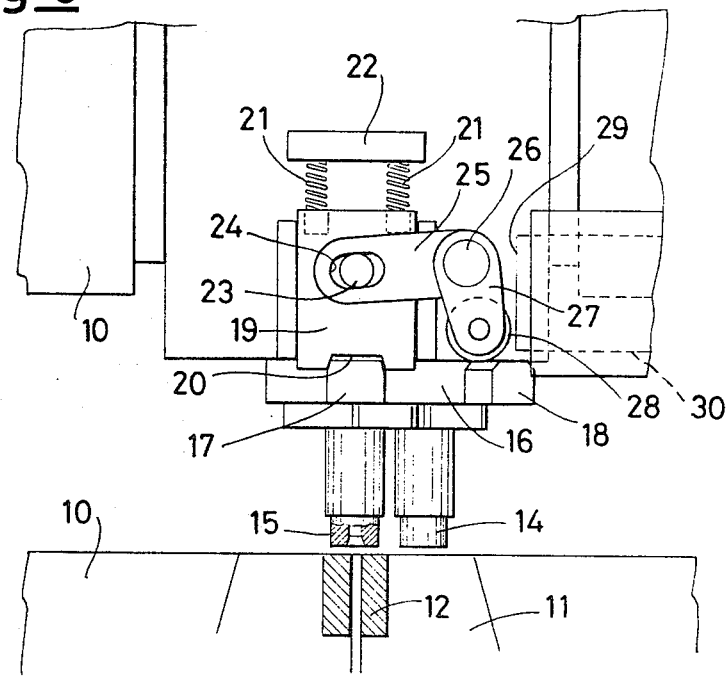

Said punches 14 and 15 are conventionally borne by a swinging plate 16 which is mounted on the front surface of the ram 13. At its top, the swinging plate 16 has two projecting extensions, 17 and 18, which, in their rear shank, have a tapered, conical outline, as can be seen in FIGS. 2, 4 and 6.

On the top portion of the ram 13 is slidably mounted, in a directon parallel to the direction of motion of the ram, a latching member 19, which has, in its front portion, a tapered, conically hollow space 20, which is intended to coact the tapered extensions, 17 and 18, of the swinging plate 16. At the rear, there are, active upon the latching member 19, two springs 21, which rest against an abutment 22 secured to the ram 13, said springs tending to push the latching member 19 forward so as to have its front hollow space 20 engaging either of the two extension 17 or 18 (see FIGS. 1–2 and 5–6).

The latching member 19, carries a pin 23, which is engageable by a slot 24: the latter slot is formed through an arm, 25, of a bell-crank lever fulcrumed about a pin 26 which is carried, in its turn, by the ram 13. The other arm 27 of the bell-crank lever in question carries a follower 28. Follower 28 is adapted to cooperate with the front surface, 29, of a pad 30, mounted for sliding within the frame 10 and drivable by a control cam (not shown) in a direction perpendicular to the direction of motion of the ram 13.

The operation of the device described in the foregoing is as follows:

The press is equipped with conventional means, not shown herein, for causing the swinging plate 16 to rock in either direction and through a preselected angle so as to bring such a plate, alternately, towards and away of either of the working positions thereof, as shown in FIGS. 1–2 and 5–6, respectively.

In either of these two positions, the first punch, 14, is correctly aligned with the axis of the die 12, whereas, in the other position, the second punch 15, is aligned with the die.

These rocking motions of the plate 16 are synchronized with the motion of the ram 13 so that they are performed partly during the "towards" stroke of the ram 13, and partly during the "away" stroke of the same ram relative to die-carrying block 11.

To make the oscillatory motions of the plate 16 possible, the plate itself must be unlatched from the latching member 19 which holds it blocked in either of its working positions.

Figure 3:
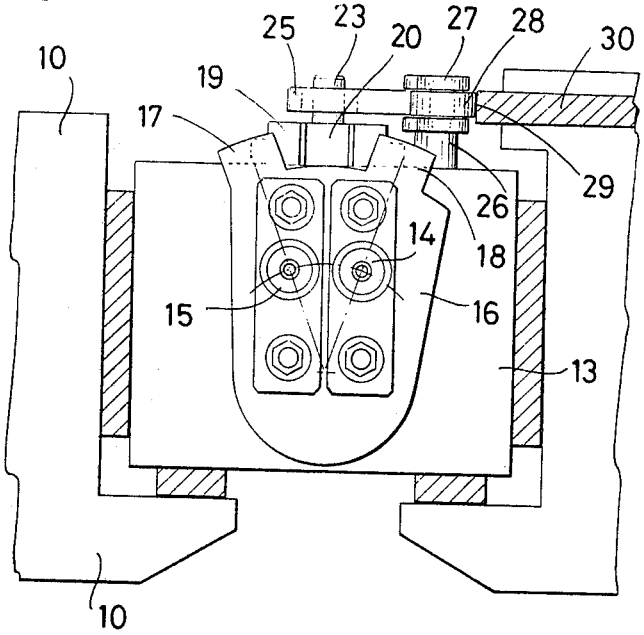
FIGS. 3–4 and 5–6 are views akin to FIGS. 1 and 2, respectively, but with the punch-carrier plate being shown during its angular swinging stroke and in its second operative position, respectively.

As a result, the pad 30, which, with its front surface, 29, is stopped very closed (a few tenths of a millimeter) to the follower 28 when the latching member 19 engages either projection 17 (or 18) of the swinging plate 16 (see FIGS. 1–2 and 5–6), is caused to go forward under the control of a cam (not shown) to push the follower 28 and thus to rock the twin-arm lever 25–27 about its pivot 28 in the sense of having the latching member 19 fed backward and thus to clear the swinging plate 16. Inasmuch as this control action takes place whereas the ram 13 and the component parts borne thereby are in motion relative to the frame 10 in which the pad 30 is mounted, the follower 28 is allowed to roll on the front surface 29 of the pad 30 (see FIGS. 3–4 in which the plate 16 is midway of its rocking motion between its two working positions). The feedback of the latching member 19 takes place against the bias of the springs 21.

When the swinging plate 16 has been rotated through the preselected angular span, the pad 30 is fed back again and the latching member 19 is pushed forward by the springs 21 until such time as its front conical hollow space 20 receives the respective tapered extension 17 (or 18, as the case may be) of the plate 16: by so doing, the self-centering and the latching of the plate 16 in its new working position is positively obtained.

The pad 30 is stopped with its front face 29 very close to the follower 28.

The foregoing description makes the advantages of the latching device of this invention fully conspicuous.

The swinging plate, as its oscillations are over, does not bump into any stop lug so that sources of noise are dispensed with and the oscillations can be effected at higher speeds.

The latching of the swinging plate in the working positions is self-centering and there is danger that foreign bodies may ever become inserted between the latching member and the plate extensions.

Lastly, also the construction of the ram is simplified because the ram has an entirely planar front surface.

I claim:

1. A latching device for the punch-carrier plate of a press for moulding screws, rivets and like articles, in which the punch-carrier plate is mounted frontally of a ram having a rectilinear reciprocal motion in a direction parallel to the axis(es) of the press die(s) and is capable of being rotated in either sense through a preselected angle between two working positions wherein it can be latched by means mounted on the ram, characterized in that it comprises a latching member slidably mounted on the ram and equipped with a frontal hollow space adapted to cooperate alternately with either of two projecting extensions integral with the punch-carrier plate, said latching member being subjected to the action of resilient means capable of keeping its frontal hollow space in engagement with either of said extensions, means being additionally provided for controllably shifting said latching member against the bias of said resilient means out of engagement with said extensions to permit the oscillation of said punch-carrier plate from either of its working positions to the other and vice versa.

2. Device according to claim 1, characterized in that the front hollow space of the latching member is conically tapered and that also the extensions of the punch-carrier plate are correspondingly conically tapered.

3. Device according to claim 1, characterized in that the means for shifting the latching member consist of a bell-crank lever mounted for rotation on the ram, an arm of said lever being engaged by the latching member, whereas the other arm carries a follower which is adapted to roll on the front surface of a control member mounted slidably on the press frame.

4. Device according to claim 3, characterized in that said control member consists of a pad having a planar front surface movable in a direction perpendicular to the sliding direction of the ram, the stroke of said pad being such that when the front hollow space of the latching member is engaging either extension of the punch-carrier plate, the front surface of said pad is very close to the follower borne by the bell-crank lever.

* * * * *